United States Patent [19]

Bothwell

[11] Patent Number: 4,858,573

[45] Date of Patent: Aug. 22, 1989

[54] INTERNAL COMBUSTION ENGINES

[76] Inventor: Peter W. Bothwell, "Meoncote" 114 Shipston Road, Stratford upon Avon, Warwickshire, United Kingdom

[21] Appl. No.: 797,478

[22] Filed: Nov. 13, 1985

Related U.S. Application Data

[63] Continuation-in-part of Ser. No. 569,316, Jan. 9, 1984, abandoned.

[30] Foreign Application Priority Data

Nov. 13, 1984 [GB] United Kingdom ..... 8428622

[51] Int. Cl.[4] ..... F01L 1/00

[52] U.S. Cl. ..... 123/90.15; 123/432; 123/90.22

[58] Field of Search ..... 123/90.16, 90.22, 90.24, 123/90.26, 90.27, 432, 308

[56] References Cited

U.S. PATENT DOCUMENTS 1,484,376 2/1924 Lanzerotti-Spina ..... 123/90.22
4,256,068 5/1981 Irimajiri ..... 123/432

FOREIGN PATENT DOCUMENTS 0063385 10/1982 European Pat. Off. .
242919 11/1925 United Kingdom .
296125 8/1928 United Kingdom .
558779 1/1944 United Kingdom .
687528 2/1953 United Kingdom .
2058913 4/1981 United Kingdom .
2134977 8/1984 United Kingdom .

OTHER PUBLICATIONS

C. Draper: "The Salmson et al Story", 1974, pp. 110–113.
L. J. K. Setrique and P. Smith: "Valve Mechanisms for High Speed Engines", p. 134.
A. Corthorn: "Ducati Motorcycles", 1984, pp. 42–43.
R. C. Renstrom: "Motor", Jun. 1974, pp. 42–43.

*Primary Examiner*—Carl Staurt Miller
*Attorney, Agent, or Firm*—Parmelee, Miller, Welsh & Kratz

[57] ABSTRACT

An internal combustion reciprocating piston engine is provided with a single overhead camshaft which operates six valves associated with a single combustion chamber by desmodromic valve gear. As viewed in a direction along the camshaft, the valves are mutually divergent in the direction from the camshaft towards the combustion chamber and some valve pairs are more divergent than the other valve pairs.

13 Claims, 3 Drawing Sheets

FIG 4
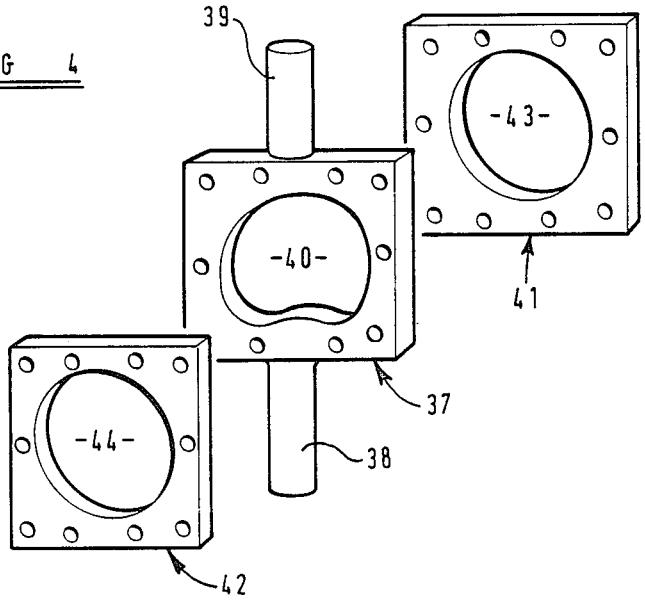
FIG 5
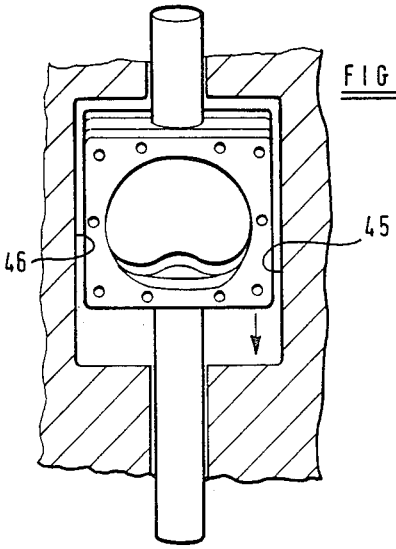
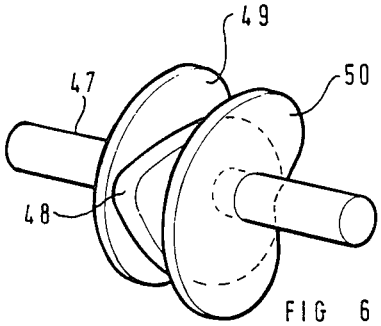
FIG 6

INTERNAL COMBUSTION ENGINES

CROSS REFERENCE TO RELATED APPLICATION

This application is a continuation-in-part of my earlier application, Ser. No. 569,316, now abandoned filed Jan. 9, 1984, entitled "Internal Combustion Engine and Cylinder Head Therefor."

BACKGROUND OF THE INVENTION

From one aspect, the present invention relates to an internal combustion reciprocating piston engine. The invention also relates to a cylinder head for use in such an engine.

In my published United Kingdom Patent Application GB No. 2,134,977A, there is described an internal combustion reciprocating piston engine comprising a cylinder head defining a plurality of valve ports which communicate with a combustion chamber defined between the cylinder head and a piston, a plurality of poppet valves, one for each port, and an overhead camshaft for operating the valves, wherein stems of the valves are so arranged that respective centrelines of the valve stems intersect an axis of rotation of the camshaft and, as viewed in a direction along the camshaft, one valve stem diverges from an adjacent valve stem in a direction away from the camshaft.

SUMMARY OF THE INVENTION

I have now discovered that one or more of the arrangements described in GB No. 2,134,977A, where there are at least three valves per combustion chamber, can be improved by inclining the stem of a first of the valves to the stem of a second of the valves, as viewed in a direction along the camshaft, at an angle different from the angle of inclination of the stem of the first valve to the stem of a third of the valves, also as viewed along the camshaft. One advantage of this arrangement is that more than four valves can conveniently be provided for a single combustion chamber.

According to a second aspect of the invention, there is provided an internal combustion reciprocating piston engine comprising a cylinder head defining at least six valve ports which communicate with a combustion chamber defined between the cylinder head and a piston, a plurality of poppet valves, one for each of said ports, and an overhead camshaft for operating all of said valves, wherein said valves have respective stems with longitudinal centrelines which substantially intersect an axis of rotation of the camshaft at first to sixth intersection positions respectively, and said intersection positions are spaced apart from each other along the camshaft axis.

According to a third aspect of the invention, there is provided an internal combustion reciprocating piston engine comprising a cylinder head defining at least five valve ports which communicate with a combustion chamber defined between the cylinder head and a piston, a plurality of poppet valves, one for each of said valve ports, and an overhead camshaft for operating all of said valves, wherein, as viewed in the direction of its movement, the piston is elongated with its length substantially parallel to an axis of rotation of the camshaft and wherein respective stems of the valves, when viewed in a direction along the camshaft axis, converge towards the camshaft.

In an engine in accordance with the third aspect of the invention, the valve stems are preferably all inclined at substantially the same angle to a reference plane containing the camshaft axis. Alternatively, the valve stems may be inclined to a reference plane containing the camshaft axis at respective angles, some of which have a first valve and others of which have a different value.

The valves of an engine in accordance with the third aspect of the invention may have respective heads which are so positioned that respective centres of the heads are, when viewed in a direction transverse to the length of the camshaft and transverse to the lengths of the valve stems, spaced apart in the direction of the length of the camshaft.

According to a fourth aspect of the invention, there is provided an internal combustion engine having an overhead camshaft, desmodromic valve gear and valves having respective stems which are convergent in a direction towards the camshaft, when the stems are viewed in a direction along the camshaft.

The desmodromic valve gear can conveniently be arranged so as not to restrict significantly the space available in the cylinder head for inlet and exhuast ducts.

The invention also provides a cylinder head for an internal combustion engine, the cylinder head having a working face which, in use, is presented towards a combustion chamber and having guide means for guiding a plurality of valves for movement along respective rectilinear paths, wherein the guide means defines a longitudinal centreline of each path, said centrelines converge towards a reference axis which is spaced from said working face in a direction which, in use, is away from the combustion chamber, said centrelines intersect said reference axis substantially at right angles and wherein said centrelines, as viewed in a direction along the reference axis, radiate in at least three different directions.

BRIEF DESCRIPTION OF THE DRAWINGS

Examples of engines embodying the present invention will now be described, with reference to the accompanying drawings, wherein:

FIG. 4 is a diagrammatic representation of components of an alternative cam follower;

FIG. 5 illustrates the alternative cam follower in association with a part of a cylinder head; and FIG. 6 shows diagrammatically a cam structure for use with the follower of FIG. 5.

DETAILED DESCRIPTION

Figure 1:
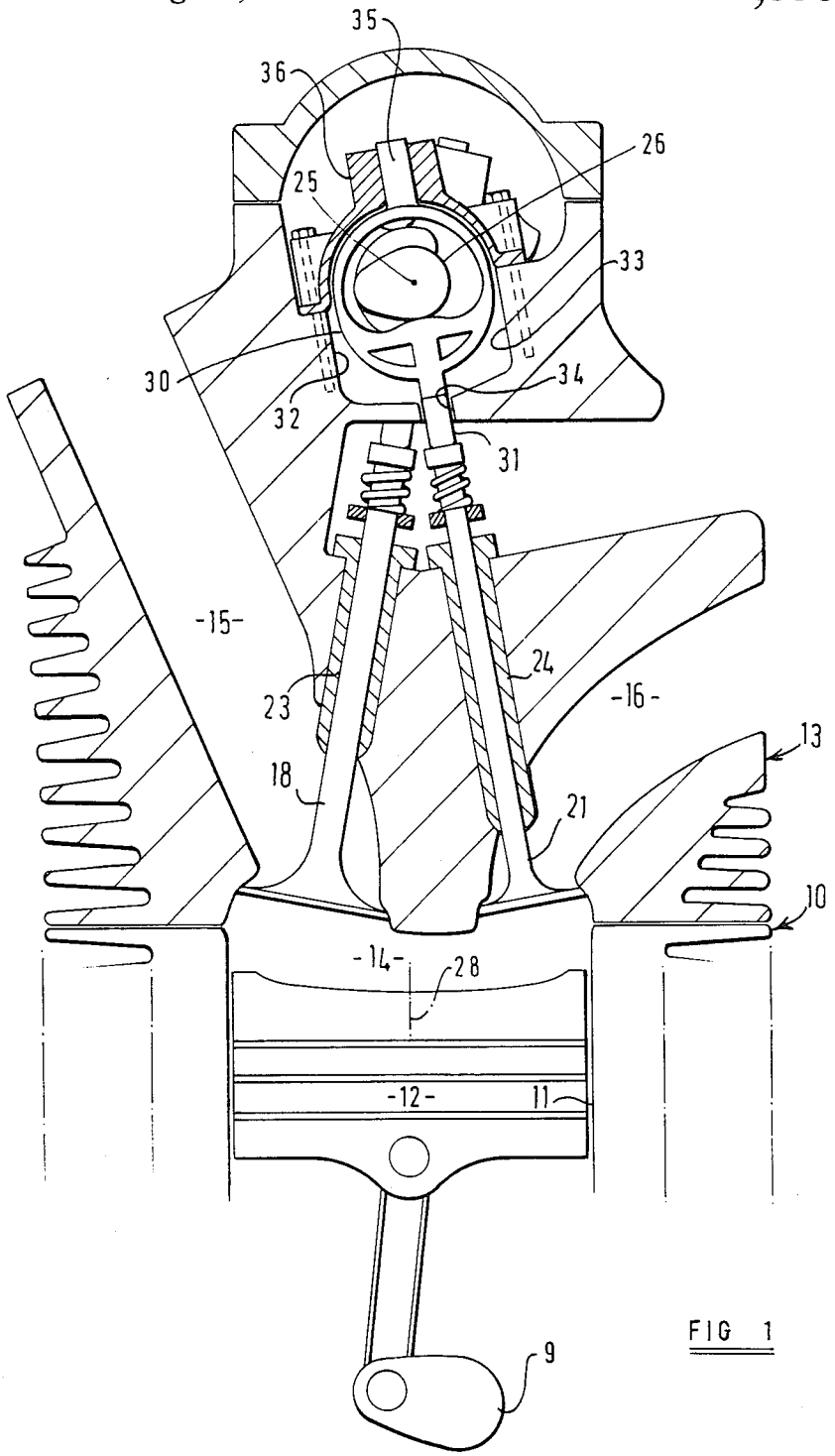
FIG. 1 shows diagrammatically a cross-section through a part of an engine, in a plane which contains an axis of a cylinder and is perpendicular to an axis of rotation of a camshaft.

The engine illustrated in FIG. 1 is a reciprocating piston, internal combustion engine which may comprise a single cylinder or a plurality of cylinders, although only a single cylinder and parts associated therewith are illustrated. The engine comprises a cylinder block 10 defining a cylindrical bore 11 containing a piston 12 connected with a crankshaft 9 in the usual way. On the block 10, there is mounted a cylinder head 13 defining four valve ports communicating with a combustion chamber 14 defined between the cylinder head and the piston. The piston presents a cavity to the combustion chamber. Alternatively, the piston could present a flat face to the combustion chamber.

The cylinder head 13 further defines three inlet ducts, one of which is shown at 15, and three exhaust ducts, one of which is shown at 16. There are mounted in the cylinder head three inlet valves 17, 18 and 19 and three exhaust valves 20, 21 and 22. The inlet valves control respective ports at which the inlet ducts terminate and the exhaust valves control respective ports at which the exhaust ducts terminate. All of these ports communicate with the combustion chamber 14.

For each valve, there is provided in the cylinder head 13 a respective valve guide. The valve guide for the valves 18 and 21 are shown at 23 and 24 respectively. The valve guides define respective longitudinal centrelines which coincide with the longitudinal centrelines of the stems of the valves. These centrelines intersect at respective positions an axis 25 of a camshaft 26 supported in the cylinder head 13 and arranged to be driven from the crankshaft in a known manner.

For the purpose of illustration, the valves 18 and 21 are shown in FIG. 1 as having their respective centrelines lying in the same plane. In fact, these centrelines lie in respective planes which are spaced apart in a direction along the camshaft axis 25.

The angle at which the valves, as viewed in a direction along the camshaft axis 25, converge is with the range 10° to 30°, preferably in the region of 15° to 20°. Accordingly, the cylinder head has a mild form of "inverse pentroof" presented to the combustion chamber 14.

Figure 2:
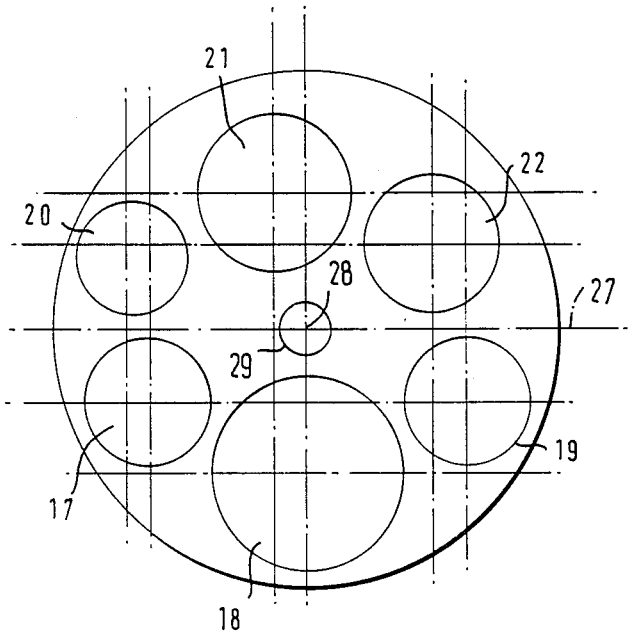
FIG. 2 shows the underside of a part of a cylinder head of the engine of FIG. 1.

As shown in FIG. 2, the head of the valve 18 is somewhat larger than are the heads of the valves 17, 19, 20 and 22. In the particular example illustrated, the head of the valve 18 is larger than the head of the valve 21. The head of the valve 18 lies generally between the heads of the valves 17 and 19. The head of the valve 21 lies generally between the heads of the valves 20 and 22.

The heads of the valves 18 and 21 lie on opposite sides of a plane 27 which contains a central axis 28 of the bore 11 and also contains the camshaft axis 25. The heads of valves 17 and 20 also lie on opposite sides of the plane 27 but are somewhat closer to that plane than are the heads of the valves 18 and 21. Similarly, the heads of the valves 19 and 22 lie on opposite sides of the plane 27 and are somewhat closer to that plane than are the heads of the valves 18 and 21.

The longitudinal axes of the stems of valves 17 and 20 are each inclined to the plane 27 at the same angle, which is a smaller angle than the angle of inclination to the plane 27 of the longitudinal axis of the centreline of the stem of each of the valves 18 and 21. The head of valve 17 is somewhat larger than is the head of valve 20, so that the head of valve 17 lies nearer to the plane 27 than does the head of valve 20. Similarly, the longitudinal centrelines of the stems of valves 19 and 22 are each inclined to the plane 27 at the same angle as are the longitudinal centrelines of the stems of valves 17 and 20. The head of valve 19 is somewhat larger than is the head of valve 22 so that the latter is spaced further from the plane 27 than is the head of valve 19.

The heads of all of the valves are spaced from the axis 28 so that there is around the axis 28 a space in the cylinder head to accommodate a spark plug 29 (not shown in FIG. 1). Thus, the electrodes of the spark plug may be positioned at the centre of the combustion chamber 14. Alternatively, the spark plug may be spaced from the centre of the combustion chamber or a plurality of spark plugs may be provided for the combustion chamber 14. The spark plug may be accommodated in a bore formed in the cylinder head 13 and lying generally above the exhaust ducts, a bore formed between adjacent ones of the inlet ducts or a bore terminating between an inlet duct and an exhaust duct.

The arrangement illustrated in FIGS. 1 and 2 may be modified by reducing the number of valves. For example, two inlet valves and a single exhaust valve may be provided. The number of inlet and exhaust ducts would be varied accordingly. In a case where a single exhaust valve is provided, the head of this valve would preferably lie at one side of the plane 27 whilst the heads of the inlet valves lie at the opposite side of that plane. The inlet valves would be arranged with longitudinal centrelines of respective stems inclined to the plane 27 at different angles.

One only of the six valves shown in FIG. 2 may be omitted and the position of the remaining five valves may be adjusted accordingly.

For operating the valves 17 and 22 of the engine illustrated in FIG. 1, there is provided desmodromic valve gear. For each valve, there is provided a respective follower. The follower of the valve 21 is indicated in FIG. 1 by the reference numeral 30. The follower has a form approximating to that of an annulus and defines a central space in which a corresponding part of the camshaft 26 is received. The follower is guided by the cylinder head 13 for reciprocation along a path parallel to that defined by the valve guide 24. Such guidance may be provided partly by surfaces 32, 33 of the cylinder head which lie on opposite sides of the camshaft and partly by a bore 34 defined by the cylinder head which lies below the camshaft and receives with sliding clearance a tappet portion 31 of the follower. If required, further guidance of the follower may be provided by co-operation between a housing 36 mounted on the cylinder head and an upward projection 35 on the follower disposed above the camshaft.

The tappet portion 31 of the follower is coupled with the stem of the valve 21 in a manner to enable the follower to move the valve downwardly to open the corresponding valve port and to move the valve upwardly to close the corresponding valve port. The coupling between the tappet portion and the valve stem may be rigid. Alternatively, the coupling may provide a small amount of lost motion and incorporate a spring which is stressed as the follower reaches its uppermost position, so that the force which holds the valve on its seat is transmitted from the follower to the valve stem via the spring.

For co-operation with the follower 30, the camshaft 26 may be provided with three distinct cam tracks arranged in succession along the camshaft. In this case, the follower 30 would be provided with three internal corresponding follower tracks. The central one of these cam tracks may co-operate with a corresponding follower track to close the valve; whilst the cam tracks which are spaced apart by that one cam track may co-operate with corresponding follower tracks to open the valve. Alternatively, the pair of cam tracks may be used to close the valve whilst the central cam track is used to open the valve.

In a case where the camshaft 26 is provided with three distinct cam tracks for co-operation with the follower 30, these cam tracks may be presented by separately formed discs which are mounted adjacent to one another on the camshaft. Similarly, the follower 30 may comprise three separately formed pieces which are assembled together. The tappet portion 31 may be integral with the remainder of the follower or formed separately and attached thereto.

A typical construction of cam follower and cams, which may be used in place of the follower and cam illustrated in FIG. 1, is shown diagrammatically in FIGS. 4, 5 and 6. The follower comprises a central component 37 having a tappet portion 38 and an upward projection 39. There is formed in the component 37 between the tappet portion and the projection an opening 40, the boundary surface of which defines a cam track which controls opening movement of the associated valve. The component 37 is secured between further components 41 and 42 which lie in face-to-face engagement with the component 37. The components 41 and 42 are formed with respective openings 43 and 44 having the same size and shape. The boundaries of these openings define cam tracks which control closing movement of the associated valve.

Each of the components 37, 41 and 42 has a pair of opposite, flat surfaces which slide on flat surface 45 and 46 defined by the cylinder block, as shown in FIG. 5. Whilst the components of the follower are represented in FIG. 4 as having generally square profiles, it will be understood that components having different profiles may be provided. Nevertheless, each component will generally have opposed flat surfaces which are co-planar with corresponding surfaces of the other components and which slide on surfaces of the cylinder head.

The cam structure for driving the follower of FIGS. 4 and 5 is shown diagrammatically in FIG. 6. The structure comprises three separate cam elements fixed on a camshaft 47, namely a central element 48 for cooperation with the cam track defined by the component 37, an outer element 49 for co-operation with the cam track defined by the component 41 and an outer component 50 for co-operation with the cam track defined by the component 42. It will be understood that the exact profiles of the cam elements and of the openings defined by the follower are not shown in FIGS. 4, 5 and 6.

As can be seen from FIG. 1, the valve gear is compact, is spaced a substantial distance from the combustion chamber 14 and does not extend far from the plane 27. This enables almost rectilinear inlet ducts to be provided and enables sharp bends to be avoided in the exhaust ducts. Furthermore, the valve gear can be readily accessible for inspection and maintenance.

It will be understood that alternative formes of desmodromic valve gear may be used in place of the particular arrangement of cams and followers illustrated in the accompanying drawings.

Figure 3:
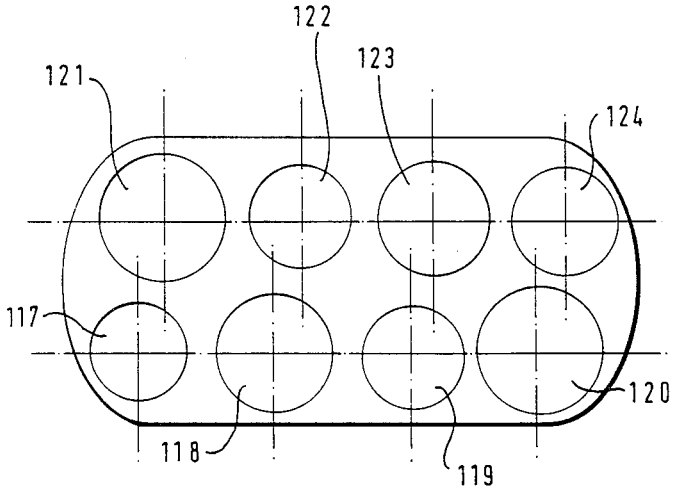
FIG. 3 is a view similar to FIG. 2 showing a part of the cylinder head of a further engine.

A modified version of the engine illustrated in FIGS. 1 and 2 is shown in FIG. 3. In this modified version, each combustion chamber is elongated, the longer dimension being parallel to the axis of the camshaft. The piston has a complementary elongated shape. There communicate with the combustion chamber through respective ports a number of ducts which exceeds four and preferably exceeds six. For example, there may be four inlet ducts and four outlet ducts. Each port is provided with a poppet valve 117–124 and the poppet valves are operated by a single, overhead camshaft.

As shown in FIG. 3, the valves of the modified engine may be arranged with respective heads in two rows, each row extending parallel to the camshaft axis. There may be provided valves having heads of different sizes. Generally, the valve heads will lie at one or other side of a plane 127 which bisects the combustion chamber and contains the camshaft axis. Some of the valve heads, for example the valve heads of larger diameter, may lie nearer to the plane 127 than do other valve heads. The longitudinal centrelines of the stems of certain of the valves are inclined to the plane 127 at a first angle, whilst the longitudinal centrelines of stems of further ones of the valves are inclined to the plane 127 at a different angle. The valves may be driven by desmodromic valve gear similar to that hereinbefore described with reference to FIG. 1.

As shown in FIG. 3, respective centres of adjacent valve heads are off-set from one another in a direction along the camshaft axis so that successive cams along the camshaft operate respective valves lying on opposite sides of the plane 127.

In both the engine illustrated in FIG. 1 and the modified engine illustrated in FIG. 3, respective longitudinal centrelines of all of the valve stems preferably intersect the camshaft axis at right angles.

I claim:

1. An internal combustion reciprocating piston engine comprising a cylinder head defining at least six valve ports which communicate with a combustion chamber defined between the cylinder head and a piston, a plurality of poppet valves, one for each port, and an overhead camshaft for operating the valves, wherein said valves have respective stems with longitudinal centrelines which substantially intersect an axis of rotation of the camshaft at first to sixth intersection positions respectively, wherein said intersection positions are spaced apart from each other along the camshaft axis, wherein respective stems of the valves are mutually inclined, the inclination of the stem of a first of the valves to the stem of a second of the valves, as viewed in a direction along the camshft, differing from the inclination of the stem of the first valve to the stem of a third of the valves, also as viewed along the camshaft.

2. An internal combustion reciprocating piston engine comprising a cylinder head defining at least three valve ports which communicate with a combustion chamber defined between the cylinder head and a piston, a plurality of poppet valves, one for each port, and an overhead camshaft for operating the valves, wherein respective stems of the valves are mutually inclined, the stems having longitudinal centerlines which substantially intersect an axis of rotation of the camshaft with said intersection positions spaced apart from each other along the camshaft axis, the inclination of the stem of a first of the valves to the stem of a second of the valves, as viewed in a direction along the camshaft, differing from the inclination of the stem of the first valve to the stem of a third of the valves, also as viewed along the camshaft, with the longitudinal centerlines of the three stems defining angles relative to one another having absolute values greater than zero, as viewed along the camshaft, and wherein the piston, as viewed in the direction of its movement, is elongated.

3. An internal combustion reciprocating piston engine comprising a cylinder head defining at least three valve ports which communicate with a combustion chamber defined between the cylinder head and a piston, a plurality of poppet valves, one for each port, and an overhead camshaft for operating the valves, wherein said valves all converge towards the camshaft, respective stems of the valves are mutually inclined, the stems having longitudinal centerlines which substantially intersect an axis of rotation of the camshaft with said intersection positions spaced apart from each other along the camshaft axis, the inclination of the stem of a first of the valves to the stem of a second of the valves, as viewed in a direction along the camshaft, differing from the inclination of the stem of the first valve to the stem of a third of the valves, also as viewed along the camshaft, with the longitudinal centerlines of the three stems defining angles relative to one another having absolute values greater than zero, as viewed along the camshaft.

4. An engine according to claim 3 wherein the combustion chamber defines an axis extending in the direction of movement of the piston and said axis intersects an axis of rotation of the camshaft.

5. An engine according to claim 3 comprising at least four of said poppet valves, associated with a common combustion chamber, wherein the stems of first and second of the valves are mutually inclined, as viewed along the camshaft, at a first angle, respective stems of third and fourth of the valves are mutually inclined, as viewed along the camshaft, at a second angle and wherein respective angles included between the first and second valve stems and between the third and fourth valve stems are bisected by a plane containing a longitudinal axis of the camshaft.

6. An engine according to claim 1 wherein first and second of said valves have respective stems which are mutually inclined, as viewed along the camshaft, at a first angle, third and fourth of said valves have respective stems which are mutually inclined, as viewed along the camshaft, at a second angle, wherein the fifth and sixth of said valves have respective stems which are mutually inclined at the same angle as are the stems of the first and second valves, the angle included between the stems of the third and fourth valves exceeds the angle included between the stems of the first and second valves, the third valve lies generally between the first and fifth valves and the fourth valve lies generally between the second and sixth valves.

7. An engine according to claim 3 wherein the piston is circular, as viewed in the direction of its movement.

8. An engine according to claim 2 wherein the longest dimension of the piston, as viewed in the direction of its movement, is substantially parallel to the camshaft axis.

9. An internal combustion engine according to claim 3, having desmodromic valve gear.

10. An engine according to claim 9 wherein the valve gear comprises a respective tappet connected with each valve stem and adapted to transmit from the camshaft to the stem a valve-closing force during one part of each operating cycle of the engine and a valve-opening force during a further part of the operating cycle.

11. An engine according to claim 10 wherein there is in the connection between each tappet and the associated valve stem a resilient element which is stressed when the valve is closed.

12. A cylinder head for an internal combustion engine, the cylinder head having a working face which, in use, is presented towards a combustion chamber and having guide means for guiding a plurality of valve for movement along respective rectilinear paths, wherein the guide means defines a longitudinal centreline of each path, said centrelines converge towards a reference axis which is spaced from said working face in a direction which, in use, is away from the combustion chamber, said centrelines intersect said reference axis substantially at right angles and wherein said centrelines, as viewed in a direction along the reference axis, radiate in at least three different directions.

13. A cylinder head according to claim 12 wherein said centrelines radiate in four different directions from the reference axis and wherein a plane containing the reference axis and which bisects the angle between the most widely divergent paths also bisects the angle between the least widely divergent paths.

* * * * *